US006571079B2

(12) United States Patent
Nagaoka et al.

(10) Patent No.: US 6,571,079 B2
(45) Date of Patent: May 27, 2003

(54) IMAGE RECORDING APPARATUS HAVING ELECTRICALLY CONDUCTIVE MEMBERS FOR PREVENTING CHARGE MIGRATION

(75) Inventors: Kazuhiko Nagaoka, Tokyo (JP); Nobutoshi Chigira, Tokyo (JP); Toyokazu Shiraishi, Tokyo (JP)

(73) Assignee: Oki Data Corporation, Tokyo (JP)

( * ) Notice: Subject to any disclaimer, the term of this patent is extended or adjusted under 35 U.S.C. 154(b) by 0 days.

(21) Appl. No.: 09/943,387

(22) Filed: Aug. 31, 2001

(65) Prior Publication Data

US 2002/0051658 A1 May 2, 2002

(30) Foreign Application Priority Data

Sep. 4, 2000 (JP) ..... 2000-267111

(51) Int. Cl.[7] ..... G03G 15/01
(52) U.S. Cl. ..... 399/299
(58) Field of Search ..... 399/297, 298, 399/299, 300, 303, 312, 313

(56) References Cited

U.S. PATENT DOCUMENTS 4,984,024 A * 1/1991 Ohkaji et al. ..... 399/299
5,189,479 A * 2/1993 Matsuda et al. ..... 399/300
5,594,538 A * 1/1997 Takekoshi et al. ..... 399/300 X

FOREIGN PATENT DOCUMENTS

JP 06-019332 * 1/1994 ..... G03G/15/16

* cited by examiner

*Primary Examiner*—Sandra Brase
(74) *Attorney, Agent, or Firm*—Rabin & Berdo, P.C.

(57) ABSTRACT

An image-recording apparatus has a plurality of image-forming sections. Each image forming section has a transfer point where a corresponding toner image is transferred from a photoconductive drum onto a print medium when the print medium passes through the transfer point. Each of the image-forming sections includes a surface that opposes the print medium and an electrically conductive film to which a high concentration of carbon black is contained and which is provided on the surface. The surface is downstream of the photoconductive drum with respect to a direction of travel of the print medium. The surface and print medium are spaced apart by a distance in the range of 1 to 3 mm and the electrically conductive member has a sheet resistance value of 15 kΩ/□ to 10 MΩ/□.

13 Claims, 9 Drawing Sheets

IMAGE RECORDING APPARATUS HAVING ELECTRICALLY CONDUCTIVE MEMBERS FOR PREVENTING CHARGE MIGRATION

BACKGROUND OF THE INVENTION

1. Field of the Invention

The present invention relates to an image recording section in which a toner image is transferred onto a print medium, and more particularly to an image recording apparatus that incorporates a plurality of image forming sections for color printing.

2. Description of the Related Art

A conventional color electrophotographic printer incorporates a plurality of image forming sections that are in cartridge form and form images of corresponding colors. A cartridge configuration is advantageous in that a cartridge of a specific toner color can be replaced at any time.

A tandem type electrophotographic printer is a type in which image forming sections of the respective colors are aligned in a direction of travel of a print medium. As the print medium passes the respective image forming sections in sequence, toner images of corresponding colors are transferred onto the print medium in order.

Each image forming section incorporates a photoconductive drum on which a toner image is developed. There is provided a transfer roller in pressure contact with the photoconductive drum. The toner image on the photoconductive drum is charged negatively. The transfer roller receives a positive high voltage. Thus, when the print medium passes a transfer point defined between the photoconductive drum and the transfer roller, the toner image formed on the photoconductive drum is attracted to the print medium.

A problem with the aforementioned tandem type electrophotographic printer is that when the leading end of the print medium approaches each of image forming sections downstream of the first image forming section, the toner particles on the downstream photoconductive drum are pulled to the print medium. This phenomenon is referred to as "migration." The higher the printing duty is, the more of toner is pulled to the print medium. This is because when toner is deposited over a large area on the photoconductive drum (i.e., high printing duty), the toner particles are attracted less strongly to the surface of the photoconductive drum. Thus, when the printing duty is high, a larger amount of toner will be pulled to the print medium.

It can be presumed that migration occurs because the print medium becomes positively charged and attracts the negatively charged toner particles on the photoconductive drum when the print medium approaches the transfer point of a downstream image forming section. Another reason for migration may be that charge accumulates gradually on a high resistance material such as plastic films (e.g., insulation film 12) during printing, resulting in non-uniform charging of the print medium.

SUMMARY OF THE INVENTION

An image-recording apparatus has a plurality of image-forming sections. Each image-forming section has a transfer point where a corresponding toner image is transferred from a photoconductive drum onto a print medium when the print medium passes through the transfer point. Each of the image-forming sections includes a surface that opposes the print medium; and an electrically conductive member provided on the surface.

The surface is downstream of the photoconductive drum with respect to a direction of travel of the print medium.

The surface and print medium are spaced apart by a distance in the range of 1 to 3 mm and the electrically conductive member has a sheet resistance value of 15 kΩ/□ to 10 MΩ/□.

The electrically conductive member is an electrically conductive film to which a high concentration of carbon black is contained.

The electrically conductive member is grounded.

The electrically conductive member is a metal and is grounded through an electrical resistor.

Another image-recording apparatus has a plurality of image-forming sections. Each image-forming section has a transfer point where a corresponding toner image is transferred from a photoconductive drum onto a print medium when the print medium passes through the transfer point. Each of the image-forming sections includes a transfer belt or medium transporting path that runs through the transfer point; and a neutralizing cloth disposed on a side of the transfer belt or medium transporting path remote from the photoconductive drum, the neutralizing cloth being disposed between a preceding transfer section and a following transfer section.

The image-recording apparatus may further include an electrically conductive member attached to a surface that opposes the print medium.

The neutralizing cloth is at least 5 mm away from the transfer point.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limiting the present invention, and wherein.

DETAILED DESCRIPTION OF THE INVENTION

Embodiments of the invention will be described in detail with reference to the accompanying drawings.

First Embodiment

Figure 1:
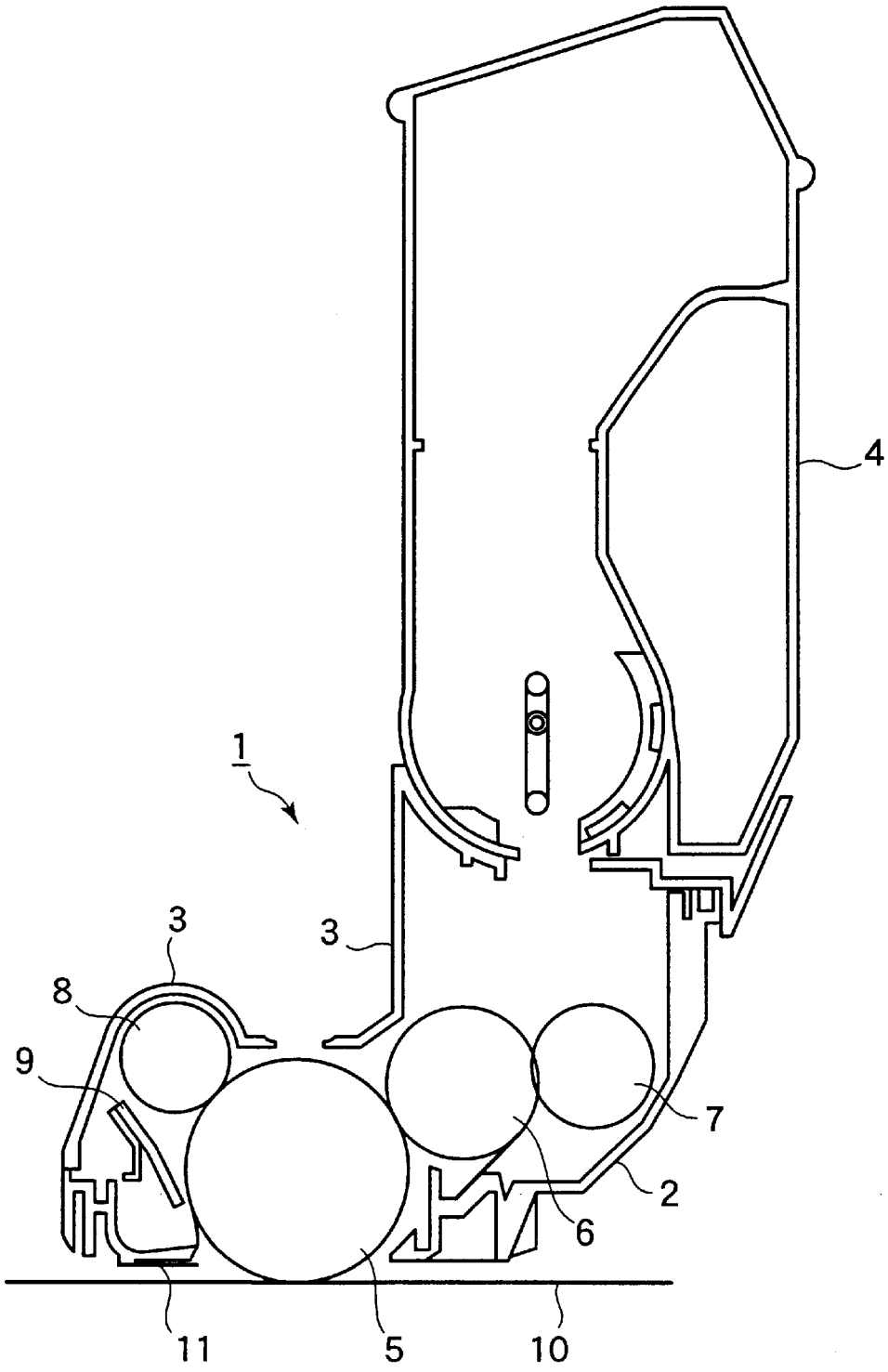
FIG. 1 is a general side view of an image forming section according to a first embodiment of the invention.

FIG. 1 is a general side view of an image forming section according to a first embodiment of the invention.

Referring to FIG. 1, an image forming section 1 includes a lower frame 2, an upper frame 3, and a toner cartridge 4. The lower frame 2 accommodates a photoconductive drum 5, a developing roller 6, and a toner supplying roller 7 therein, all of which being rotatably supported. The upper frame 3 houses a charging roller 8 and a cleaning blade 9, and supports the toner cartridge 4 attached thereon.

A transport belt 10 is disposed immediately below the image forming section 1 and runs with a print medium placed thereon. The lower frame 2 has a lower surface 2*a* that opposes the transport belt 10.

Figure 2:
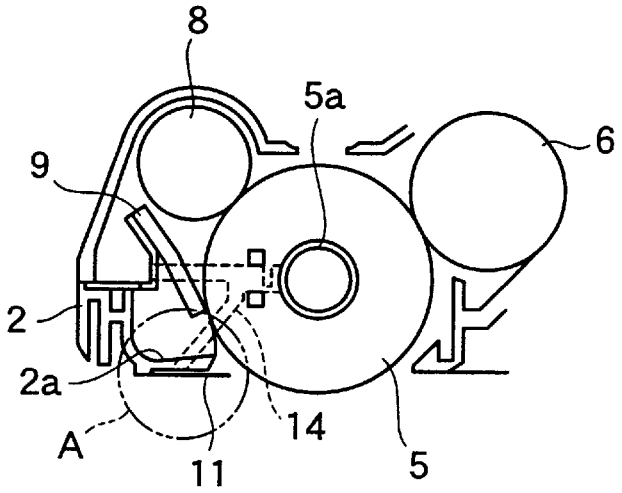
FIG. 2 is a general cross-sectional side view, illustrating a pertinent portion of the image forming section.

FIG. 2 is a general cross-sectional side view, illustrating a pertinent portion of the image forming section.

Figure 3:
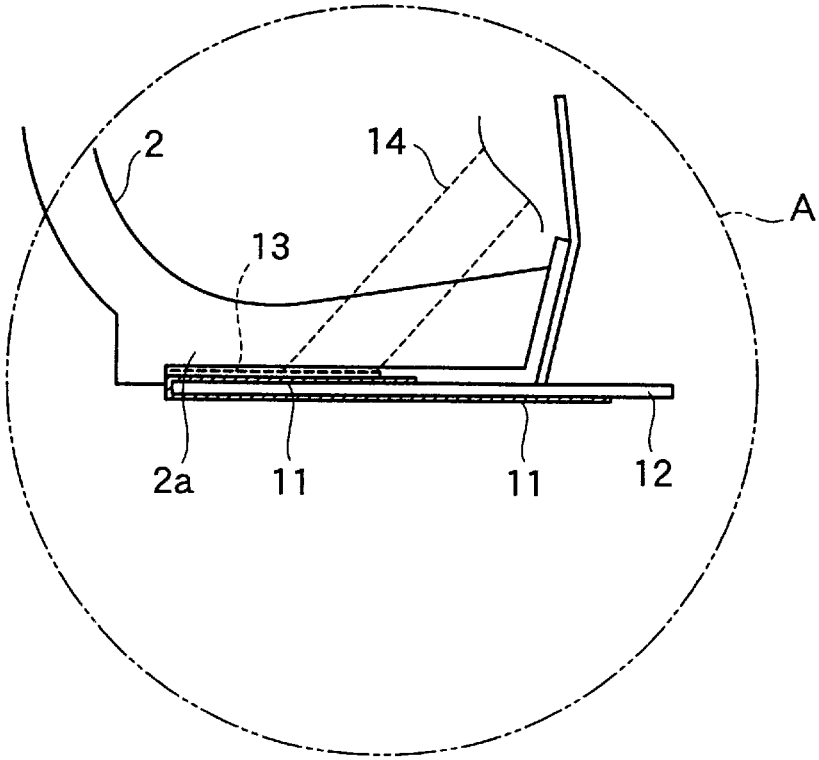
FIG. 3 is an expanded cross-sectional side view of a portion in FIG. 2, depicted by A.

FIG. 3 is an expanded cross-sectional side view of a portion in FIG. 2, depicted by A.

Figure 4:
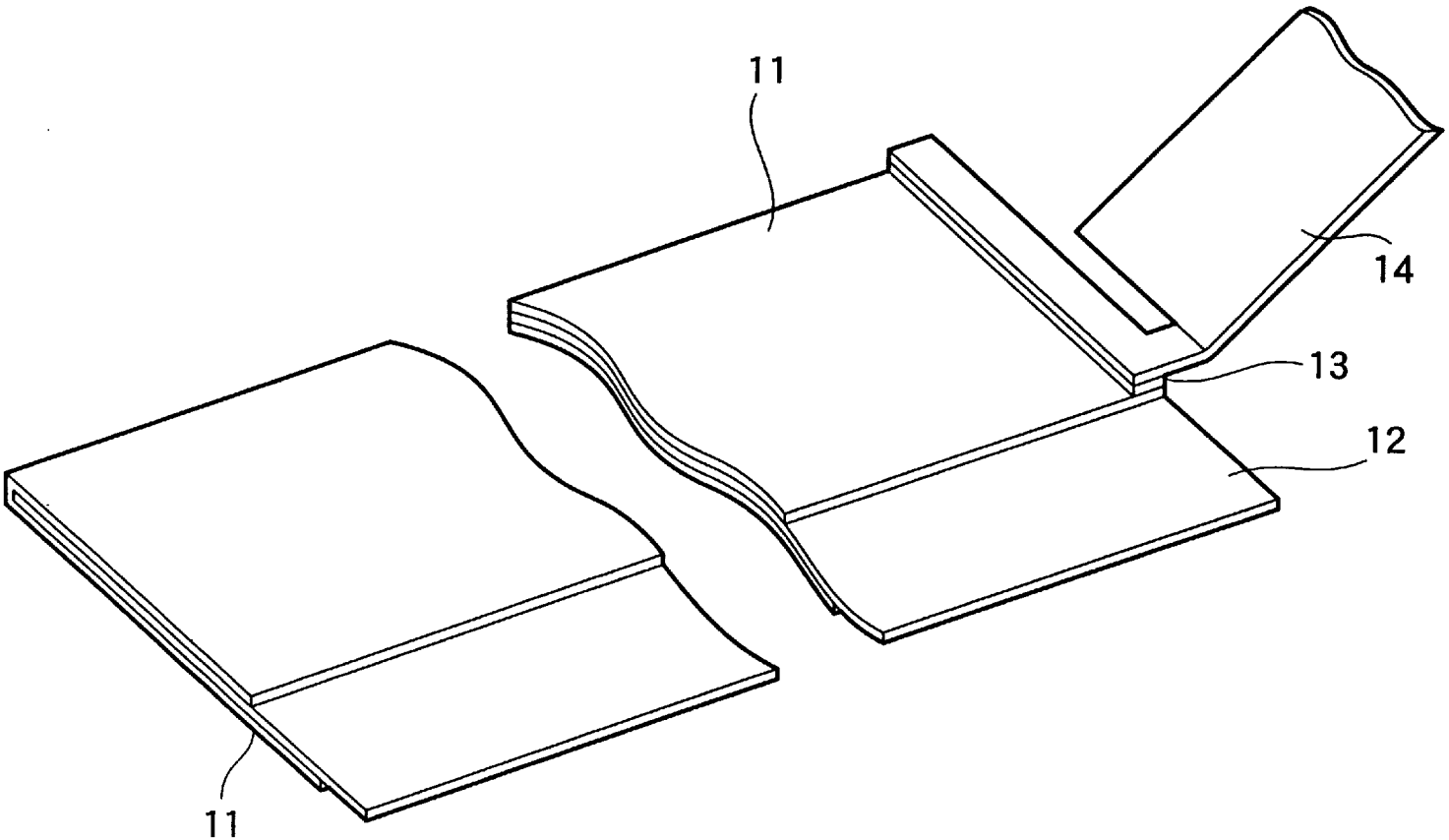
FIG. 4 is a fragmentary perspective view, illustrating an insulation film surrounded by an electrically conductive film.

FIG. 4 is a fragmentary perspective view, illustrating an insulation film surrounded by an electrically conductive film.

Referring to FIGS. 2 and 3, the lower frame 2 is formed with a shallow recess whose bottom is the surface 2*a*. The shallow recess receives an upper portion of a generally U-shaped electrically conductive film 11 and a part of a metal plate 14. An insulation film 12 is a member that prevents the toner, scraped by the cleaning blade 9 from the photoconductive drum 5, from dropping in the transfer point or the print medium. The insulation film 12 is surrounded by the generally U-shaped electrically conductive film 11 that has one end thereof connected to a metal plate 14 by an electrically conductive double stick tape 13. The insulation film 12 is in direct contact with an area of the lower frame 2 from where the electrically conductive film 11 is absent. The metal plate 14 has one end thereof electrically connected to the electrically conductive film 11 and the other end thereof electrically connected to a shaft 5*a* of the photoconductive drum 5. The shaft 5*a* is connected to the ground through a contact, not shown.

Figure 5:
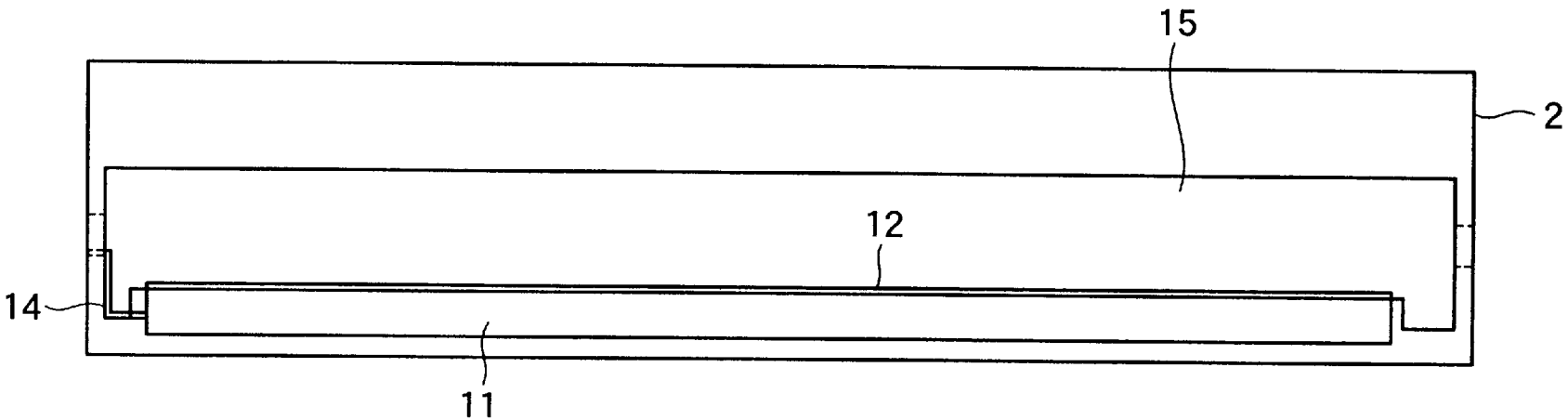
FIG. 5 is a bottom view of the lower frame.

FIG. 5 is a bottom view of the lower frame.

Referring to FIG. 5, the electrically conductive film 11 extends over substantially entire length of the lower frame 2, which in turn extends across the width of the transport belt 10. The electrically conductive film 11 has one end thereof connected to the metal plate 14. The lower frame 2 has a rectangular opening 15 formed therein through which a part of the photoconductive drum 5 extends outwardly.

The electrically conductive film 11 is made of a plastic film that contains a high concentration of carbon black and therefore has a sheet resistance of 15 kΩ/□ to 10 MΩ/□. A resistance value in this range is suitable when the distance between the print medium and the lower surface 2*a* of the lower frame 2 is in the range from 1 to 3 mm. The resistance value may be selected in accordance with the distance between the print medium and the lower surface 2*a*. If the distance is shorter, the resistance value may be decreased. Conversely, if the distance is longer, the resistance value may be increased.

Figure 6:
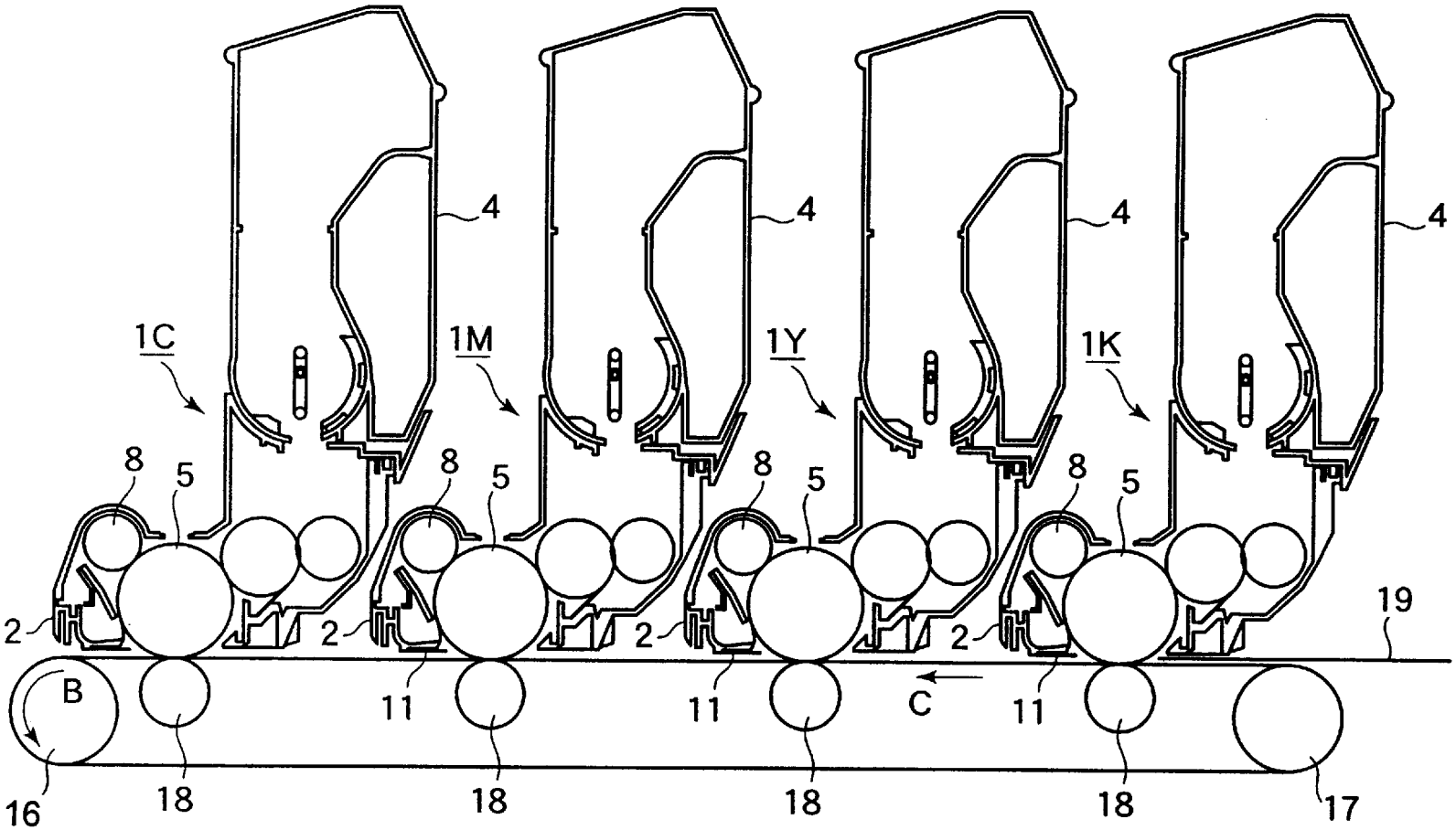
FIG. 6 is a general side view illustrating four image-forming sections.

FIG. 6 is a general side view illustrating four image-forming sections.

Referring to FIG. 6, the image forming sections 1K–1C for black, yellow, magenta, and cyan images are aligned from right to left in this order. The electrically conductive film 11 is provided on the lower surface 2*a* of the lower frame of the respective image forming section. The transport belt 10 is entrained about a drive roller 16 and a driven roller 17. When the drive roller 16 rotates in a direction shown by arrow B, the transport belt 10 runs in a direction shown by arrow C. Transfer rollers 18 are disposed to oppose the photoconductive drums 5 such that the transport belt 10 runs between each transfer roller 18 and a corresponding photoconductive drum 5.

When the leading end of the print medium approaches each image forming section after the first section, migration may occur. Migration occurs between the print medium that has just passed a preceding image forming section, and a following image forming section. Thus, the final one (i.e., cyan) of the image forming sections need not have the electrically conductive film 11.

Referring to FIG. 6, when a printing operation is performed, the photoconductive drum 5 and the respective rollers are driven into rotation and the charging roller 8 charges the surface of the photoconductive drum 5. Then, an exposing unit, not shown illuminates the charged surface in accordance with print data to form an electrostatic latent image. Then, the developing roller 6 deposits toner on the surface of the photoconductive drum 5 so that the electrostatic latent image is developed with toner into a toner image.

The print medium 19 is fed from a paper cassette, not shown, onto the transport belt 10 and the print medium 19 is fed between the transport belt 10 and the photoconductive drum 5 for black image in timed relation to the formation of a toner image. When the print medium 19 is pulled in between the photoconductive drum 5 and the transport belt 10, the transfer roller 18 causes the black toner image on the photoconductive drum 5 to be transferred to the print medium 19.

When the print medium 19 passes the transfer point defined between the photoconductive drum 5 and the transfer roller 18, the lower frame 2 of the image forming section 1K for black is positively charged. However, the electrically conductive film 11 prevents the lower frame 2 from being charged excessively, so that the charging of the lower frame 2 does not cause the print medium 19 to be charged non-uniformly.

The print medium 19 is further transported to the image forming section 1Y for yellow where a yellow toner image is transferred onto the print medium 19. When the print medium 19 is pulled between, migration may occur if the charging of lower frame 2 influences the print medium 19 so that the print medium 19 is charged uniformly. In the present embodiment, the electrically conductive film 11 prevents the print medium 19 from being charged non-uniformly, thereby preventing migration of toner.

The print medium 19 is further transported to the image forming section 1M for magenta and then the image forming section 1C for cyan. Because of the presence of the electrically conductive film 11, the respective toner images are transferred without migration.

TABLE 1

| Configuration | Migration | Discharge | Noise |
|---|---|---|---|
| (Case 1) Insulation film + metal plate (open) | NO | SOME | YES |

TABLE 1-continued

| Configuration | Migration | Discharge | Noise |
|---|---|---|---|
| (Case 2) Insulation film + metal plate (FG) | NO | NO | NO |
| (Case 3) Insulation film | YES | NO | NO |
| (Case 4) Insulation film + conductive film (FG) | NO | SOME | NO |
| (Case 5) Conductive film (FG) | NO | SOME | NO |

FG denotes a potential (i.e., 0 volts) at the frame ground.

Table 1 lists occurrence of migration when a metal plate or the electrically conductive film 11 is attached to the insulation film 12. "Configuration" indicates combinations of various types of members combined with the insulation film 12. "Discharge" indicates migration of toner due to the fact that negatively charged toner particles repel one another to scatter.

In Case #1, a metal plate was attached to the insulation film 12 and the metal plate was left ungrounded. Migration did not occur. However, because the metal plate was floating electrically, the charge was accumulated gradually on the insulation film 12 and then discharged to the photoconductive drum to radiate noise. In Case #2, a metal plate was connected to the insulation film 12 and the metal plate was grounded. Neither migration occurred nor noise was radiated. However, there was a tendency that discharge occurs when the print medium 19 takes the form of a transparency. This may be due to the fact that the metal plate has too a small resistance value so that the toner is attracted more strongly to the metal plate than to the OHP and the toner on the transparency discharges to scatter. Cases #1, #4, and #5 appear to be substantially the same in terms of migration and discharge but noise is detected for case #1 only. This is due to the fact that the amount of charge is different for Cases #1, #4, and #5.

In Case #3, nothing was connected to the insulation film 12. Migration occurred. Also the toner on the photoconductive drum 5 scattered due to discharge. This may be due to the fact that the insulation film 12 is charged more positively so that the toner on the photoconductive drum 5 is attracted to the insulation film 12. In Case #4, a high leak electrically conductive film was connected to the insulation film 12 and the electrically conductive film 11 was connected to the ground. Neither migration nor noise occurred. The electrically conductive film 11 contained a high concentration of carbon black and had a surface resistance (sheet resistance) of no more $1\times10^4\Omega$. In Case #5, only electrically conductive film was used. The use of the electrically conductive film alone provides substantially the same effects as the Case #4.

In the first embodiment, the electrically conductive film 11 neutralizes the lower frame 2 so that the print medium 19 is less influenced by the charging of the lower frame 2. It is to be noted that the print medium 19 is more charged at the final image forming section (cyan) than at the first image forming section (black). Thus, the surface resistance (sheet resistance) of the electrically conductive film 11 may be changed in accordance with the order in which the image forming sections are aligned such that a preceding image forming section has a higher resistance value than a following image forming section.

In conventional tandem type electrophotographic printers, the transfer roller 18 at a preceding image forming section receives a higher voltage than the transfer roller 18 at a following image forming section. This is because an increasingly strong toner-attracting force is required as the print medium 19 passes through the image forming sections one after another since toner images are deposited one over the other in such a way that a following toner image is deposited on a preceding toner image. Thus, it is desirable that a following image forming section has a lower resistance value than a preceding image forming section.

As mentioned above, migration can be prevented by connecting the electrically conductive member 11 to the insulation film 12. Connecting the electrically conductive film 11 to the ground prevents the toner from scattering from the print medium 19 due to discharge. The use of an electrically conductive material with some resistance prevents noise from being radiated. The electrically conductive film 11 may take the form of a metal member and may be connected to the ground through a resistor, while still maintaining the same effect.

Figure 7:
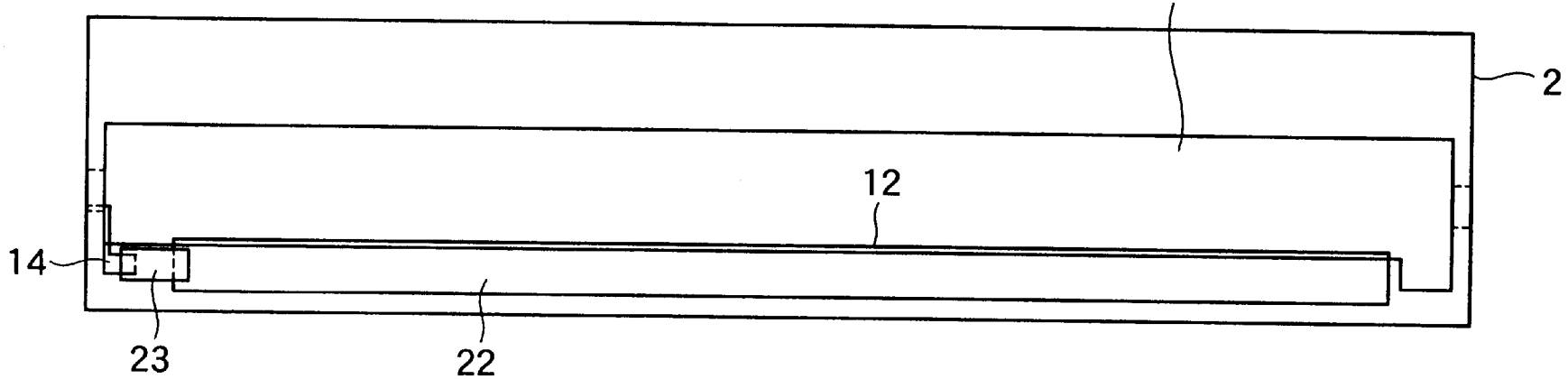
FIG. 7 is a bottom view of the lower frame 2 illustrating a case in which the metal film is connected to the ground.

FIG. 7 is a bottom view of the lower frame 2 illustrating a case in which the metal film is connected to the ground.

Referring to FIG. 7, the insulation film 12 extends across substantially the entire length of the lower frame 2 and a metal plate 22 is attached to the insulation film 12. A resistor 23 is connected between the metal plate 14 and the metal plate 22. The metal plate 14 is connected to the shaft 5*a* of the photoconductive drum 5. The resistance value of the resistor 23 ranges from 15 kΩ to 10 MΩ. This configuration also provides the same effect as the case where the electrically conductive film 11 is connected to the ground.

The resistor 23 in FIG. 7 may be attached to the main body of the printer, in which case, the metal plate 22 is arranged such that the metal plate 22 is brought into contact engagement with the resistor 23 on the main body of the printer when the image forming section is placed in position in the printer.

Figure 8:
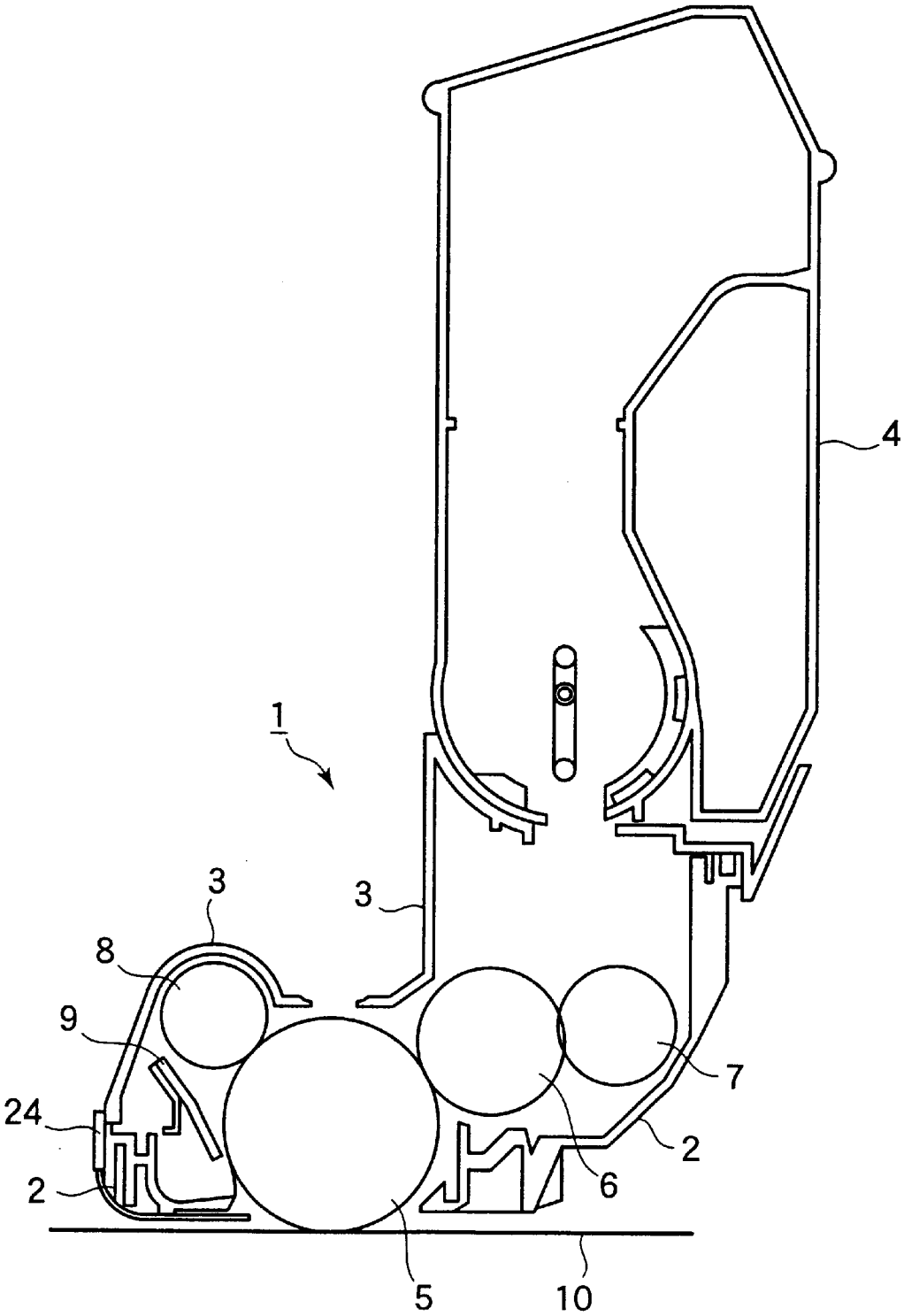
FIG. 8 illustrates a still another modification to the first embodiment.

FIG. 8 illustrates a still another modification to the first embodiment.

Referring to FIG. 8, a discharge cloth 24 is provided on the side portion of the lower frame 2 and is in contact with the electrically conductive film 11. This configuration allows the charge accumulated on the electrically conductive film 11 to discharge by itself, thereby preventing migration. In this modification, it is not necessary that the electrically conductive film 11 is connected to the ground.

Second Embodiment

Figure 9:
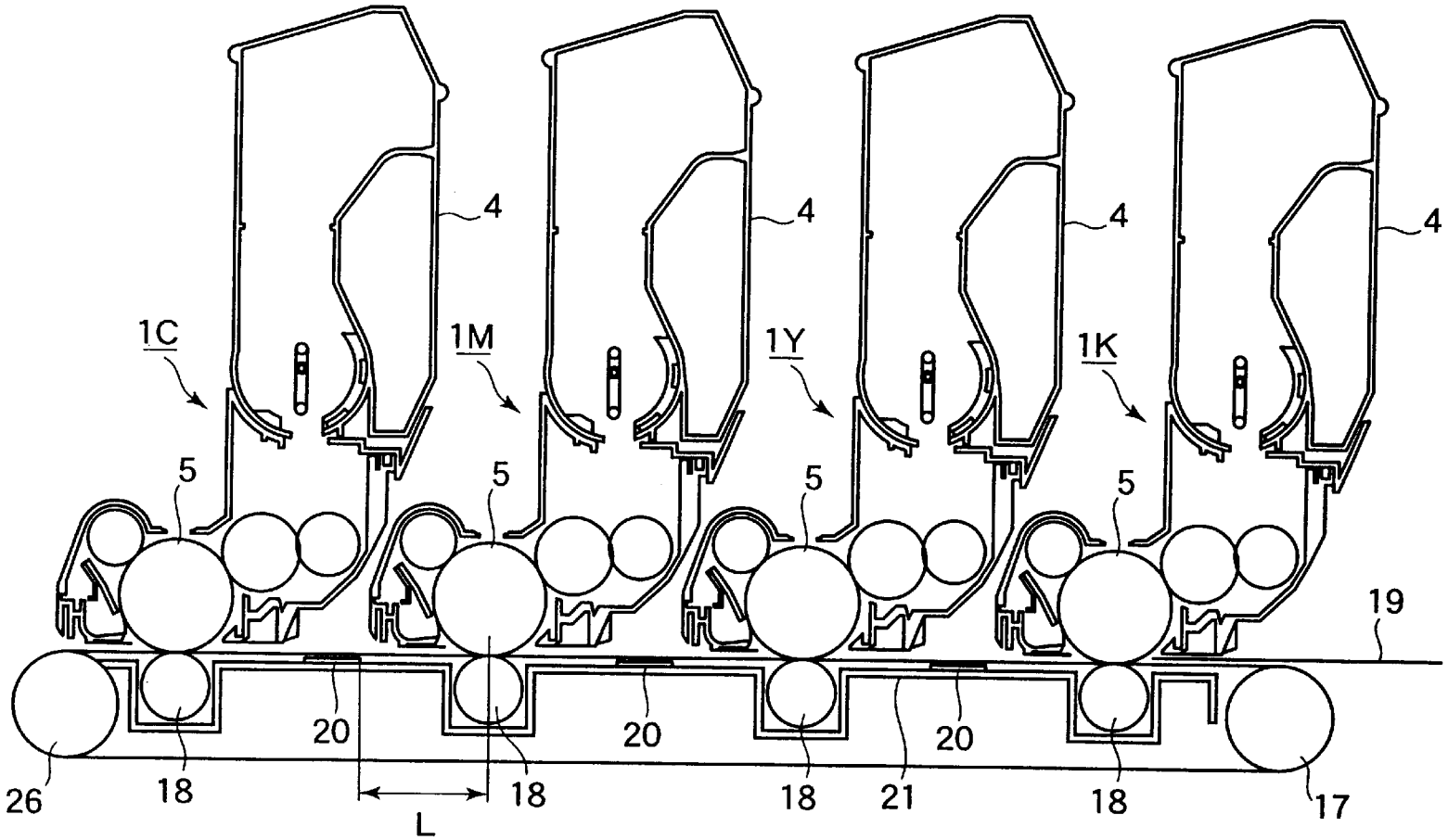
FIG. 9 is a general side view, illustrating image-forming sections according to a second embodiment.

FIG. 9 is a general side view, illustrating image-forming sections according to a second embodiment.

Figure 10:
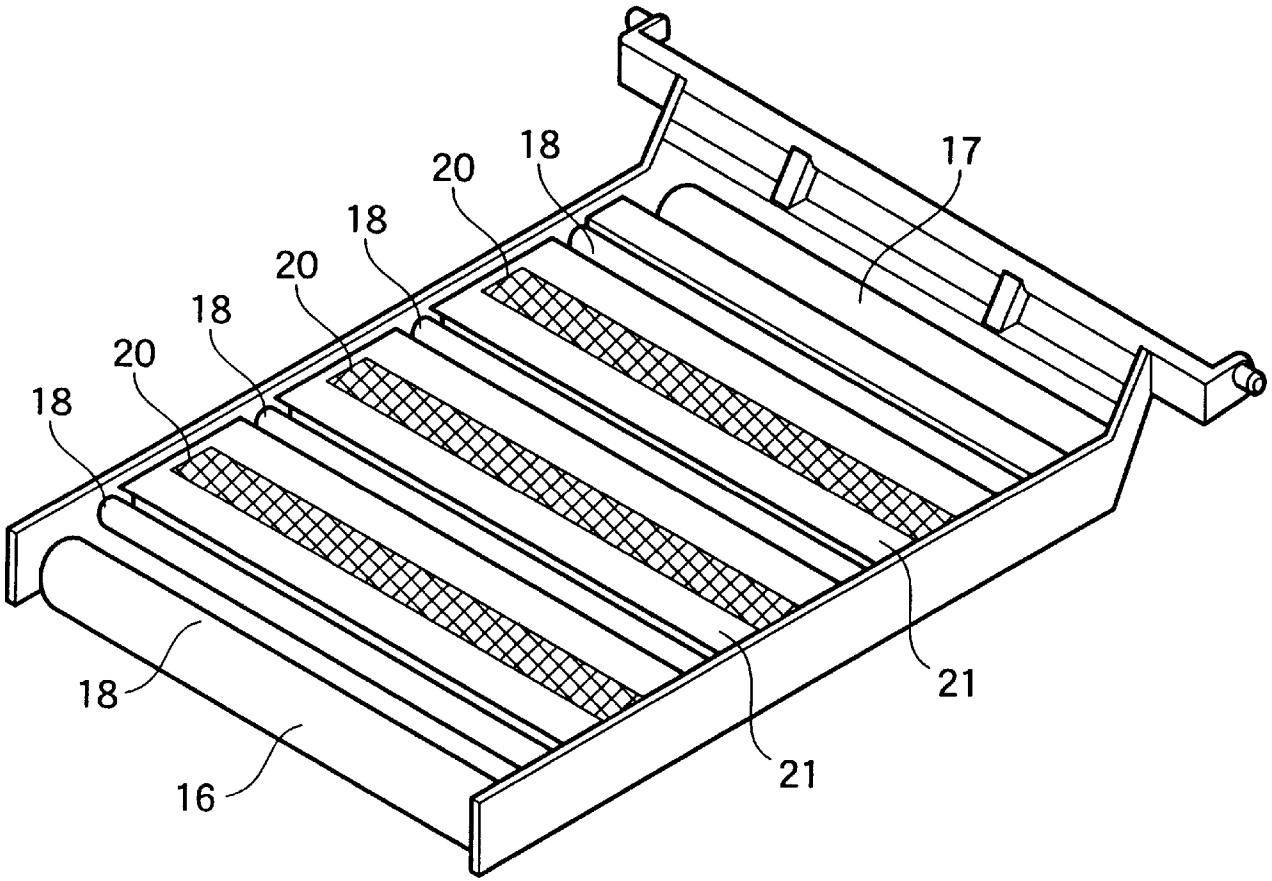
FIG. 10 is a perspective view, illustrating the image-forming sections according to the second embodiment when the transport belt is disassembled therefrom.

FIG. 10 is a perspective view, illustrating the image-forming sections according to the second embodiment when the transport belt is disassembled therefrom.

Referring to FIGS. 9 and 10, the second embodiment differs from the first embodiment in that a neutralizing cloth 20 is disposed between adjacent image forming sections. The neutralizing cloth 20 is spaced away by a distance L from the center of a nip formed between the transfer roller and the photoconductive drum. Specifically, there are provided flat frames 21 between adjacent image forming sections and the transport belt 10 runs on the frames 21. As shown in FIG. 10, the neutralizing cloth 20 extends substantially across the entire length of the transfer roller 18. The neutralizing cloth 20 may take the form of polymer to which an electrically conductive material such as carbon is added, or the form of unwoven cloth formed of electrically conductive polymer.

The distance between the neutralizing cloth 20 and the upper portion of the transport belt 10 should be selected to be less than 5 mm and the neutralizing cloth 20 may be in contact with the transport belt 10. The distance between the neutralizing cloth 20 and a nip formed between the photoconductive drum 5 and the transfer roller 18 should be longer than 5 mm. Disposing the neutralizing cloth 20 too close to the transfer roller 18 may cause the charge stored on the neutralizing cloth 20 to be discharged to radiate noise. Thus, the neutralizing cloth 20 should be such that it can store a certain amount of charge. The neutralizing cloth 20 is not grounded. Alternatively, the neutralizing cloth 20 may be made of an electrically conductive material having a high resistance value.

With the second embodiment of the aforementioned construction, experiments were conducted to determine the occurrence of migration. Table 2 lists the results.

TABLE 2

| Configuration | Width of neutralizing cloth (mm) | Migration | Discharge | Noise |
|---|---|---|---|---|
| (Case 5) Insulation film + conductive film (FG) | 50 | NO | NO | YES |
| (Case 6) Insulation film + conductive film (FG) | 20 | NO | NO | NO |
| (Case 7) Insulation film + conductive film (FG) | 15 | NO | NO | NO |

Referring to Table 2, migration did not occur in Case #5 where the neutralizing cloth 20 has a width of 50 mm. In Cases #6 and 7, the neutralizing cloth 20 has a narrower width of 20 mm and 15 mm respectively. In other words, disposing the neutralizing cloth 20 a distance L (FIG. 9) away from the transfer roller 18 improves radiated noise. This may be due to the fact that a smaller width of the neutralizing cloth 20 stores less charge or that a longer distance between the neutralizing cloth 20 and the transfer roller 18 prevents discharge. Cases #5, #6, and #7 appear to be substantially the same in terms of migration and discharge but noise is detected for Case #5 only. This is due to the fact that the area of the neutralizing cloth 20 determines the occurrence of noise.

In the second embodiment, the electrically conductive film 11 may be omitted and only the neutralizing cloth 20 may be provided.

The present invention is not limited to the aforementioned embodiments and a variety of modifications may be made without departing from the scope of the invention. For example, in the first embodiment, the lower frame 2 of the image forming section 1 may be formed of an electrically conductive material having a predetermined resistance value (i.e., 15 kΩ/□ to 1MΩ/□) in stead of providing the electrically conductive film 11, thereby preventing migration. Further, the first embodiment may be modified in such a way that the metal plate 14 is provided on the lower surface 2*a* and the electrically conductive film 11 is between the metal plate 14 and the shaft 5*a* of the photoconductive drum 5.

The invention being thus described, it will be obvious that the same may be varied in many ways. Such variations are not to be regarded as a departure from the spirit and scope of the invention, and all such modifications as would be obvious to one skilled in the art intended to be included within the scope of the following claims.

What is claimed is:

1. An image-recording apparatus having a plurality of image-forming sections each of which has a transfer area where a corresponding toner image is transferred from a photoconductive drum onto a print medium when the print medium passes through the transfer area, at least one of the image-forming sections comprising:

an insulating frame having a surface that directly faces the print medium; and an electrically conductive member provided on said surface, said electrically conductive member being positioned downstream of the photoconductive drum with respect to a direction of travel of the print medium, and extending substantially in a direction of a rotation axis of the photoconductive drum.

2. The image recording apparatus according to claim 1, wherein said surface and said print medium are spaced apart by a distance in the range of 1 to 3 mm.

3. The image recording apparatus according to claim 1, wherein said electrically conductive member is an electrically conductive film to which a high concentration of carbon black is contained.

4. The image recording apparatus according to claim 1, wherein said electrically conductive member is grounded.

5. The image recording apparatus according to claim 1 wherein said electrically conductive member is metal.

6. The image recording apparatus according to claim 1, further comprising a transport roller that extends in a direction substantially perpendicular to the direction of travel of the print medium, wherein said electrically conductive member extends across a length of the transport roller.

7. The image recording apparatus according to claim 1, wherein said electrically conductive member is grounded through a resistor.

8. The image recording apparatus according to claim 1, wherein said electrically conductive member has an electrical resistance value in the range of 15 kΩ/□ to 10 MΩ/□.

9. An image-recording apparatus having a plurality of image-forming sections each of which has a transfer area where a corresponding toner image is transferred from a photoconductive drum onto a print medium when the print medium passes through the transfer area, the image-recording apparatus comprising:

a medium transporting path that runs through the transfer area, the transfer area extending in a direction substantially perpendicular to a direction of travel of the print medium; and a neutralizing member disposed on a side of said medium transporting path remote from the photoconductive drum, said neutralizing member being disposed between a preceding transfer section and a following transfer section, said neutralizing member extending across a length of the transfer area.

10. The image-recording apparatus according to claim 9, further comprising an insulating frame having a surface that opposes the print medium, wherein said neutralizing member is provided on the surface across a length of the transfer area.

11. The image-recording apparatus according to claim 9, wherein the transfer area is a nip formed between the photoconductive drum and a transfer roller in contact with the photoconductive drum, and said neutralizing member is at least 5 mm away from the transfer area.

12. The image-recording apparatus according to claim 9, wherein said neutralizing member is a neutralizing cloth.

13. The image-recording apparatus according to claim 9, wherein said neutralizing member is electrically conductive.

* * * * *